United States Patent [19]

Kuroda et al.

[11] Patent Number: 4,500,035

[45] Date of Patent: Feb. 19, 1985

[54] EXPANSION VALVE

[75] Inventors: Shigeaki Kuroda, Shimizu; Takao Senshu, Shizuoka; Kensaku Oguni; Taketoshi Mochizuki, both of Shimizu; Hiromu Yasuda, Shizuoka; Kyuhei Ishibane; Akira Atsumi, both of Shimizu; Hideyuki Kimura; Toshio Hatada, both of Ibaraki, all of Japan

[73] Assignee: Hitachi, Ltd., Tokyo, Japan

[21] Appl. No.: 506,384

[22] Filed: Jun. 21, 1983

[30] Foreign Application Priority Data

Jun. 25, 1982 [JP] Japan ..... 57-108417

[51] Int. Cl.[3] ..... G05D 27/00; F25B 41/04

[52] U.S. Cl. ..... 236/92 B; 62/225; 137/503; 137/508

[58] Field of Search ..... 236/92 B, 92 R; 62/225; 137/503, 508

[56] References Cited

U.S. PATENT DOCUMENTS

| | | | |
|---|---|---|---|
| 2,538,436 | 1/1951 | Weinberg | 137/508 X |
| 2,938,540 | 5/1960 | Schatzman et al. | 137/508 |
| 2,967,403 | 1/1961 | Lange et al. | 236/92 B X |
| 4,032,070 | 6/1977 | Nielsen | 236/92 B |

*Primary Examiner*—William E. Tapolcai

*Attorney, Agent, or Firm*—Antonelli, Terry & Wands

[57] ABSTRACT

An expansion valve has a refrigerant inlet passage, a refrigerant outlet passage, a valve chest to which both the passages open, a diaphragm chamber communicating with a heat-sensitive bulb through a tube of small diameter, and a valve body actuated in response to the operation of a diaphragm, the valve body being disposed facing a valve seat in the valve chest to regulate a passage defined between the valve seat and the valve body, to thereby control the flow rate of a refrigerant. The valve seat is adapted to be axially movable along the inner wall of the valve chest. In addition, means are provided for moving the valve seat in accordance with a change in pressure in the refrigerant circuit.

5 Claims, 7 Drawing Figures

EXPANSION VALVE

BACKGROUND OF THE INVENTION

The present invention relates to an expansion valve provided in a refrigerant circuit of a refrigerating apparatus, air conditioner or the like and employed as a pressure reducing device for controlling the flow rate of a refrigerant.

As the pressure reducing devices for controlling the refrigerant flow rate in such a refrigerant circuit, a capillary tube and a thermostatic expansion valve are generally employed.

The capillary tube, which is adapted to regulate the refrigerant flow rate by means of the resistance of the passage in a tube having a very small bore, is suitable for use in a refrigerant circuit in which the condensing pressure and the evaporating pressure will not largely vary from the respective design points. In a refrigerant circuit in which such operating conditions largely change, however, the capillary tube cannot properly control the refrigerant flow rate, disadvantageously resulting in an excessive superheating of the refrigerant or liquid back to offer adverse effects to the refrigerant circuit or compressor.

On the other hand, the thermostatic expansion valve of the type disclosed in, for example, Japanese patent publication No. 9434/1978, represents a pressure reducing device which controls the refrigerant flow rate by sensing the temperature of a refrigerant circulating through a refrigerant circuit and controlling the valve opening in accordance with the sensed temperature.

The thermostatic expansion valve has a refrigerant inlet passage to be connected to the high-pressure side of a refrigerant circuit, a refrigerant outlet passage to be connected to the low-pressure side of the refrigerant circuit, and a valve seat as well as valve chest providing communication between both the passages. Further, a heat-sensitive bulb charged with a gas or liquid whose pressure varies with temperature, e.g., a refrigerant is connected to and opened into a diaphragm chamber through a tube of small diameter. To a diaphragm in the diaphragm chamber, the upper end of a valve stem is fixed, and a conical valve body facing the valve seat is provided on the lower end of the valve stem.

The heat-sensitive bulb is attached to an outlet conduit of an evaporator and is adapted to transmit a pressure corresponding to the temperature of the refrigerant circulating through the conduit to the diaphragm chamber through the tube of small diameter to transform the diaphragm by means of the transmitted pressure. This operation of the diaphragm causes the valve body to move through the valve stem to vary the degree of the opening in the valve seat portion, thereby to control the refrigerant flow rate.

However, such a thermostatic expansion valve also has a limit in transformation (valve lift) of the diaphragm; hence, it is difficult for the valve to effect the flow rate control over a wide range.

The above-mentioned prior art has also disclosed that a controllable flow rate range is enlarged by modifying the shape of the valve body, thereby to meet the demand for a flow rate control over a wider range.

More specifically, the valve body provided on the lower end of the valve stem is formed having a curved sealing surface, thereby increasing a maximum controllable flow rate. This method is, however, still insufficient for enlarging the controllable flow rate range, so that it is unfavorably impossible to allow a refrigerating apparatus or the like to exhibit its performance thoroughly.

BRIEF SUMMARY OF THE INVENTION

Accordingly, it is a primary object of the invention to provide an expansion valve capable of properly controlling the flow rate of the circulating refrigerant over a wider operating range, particularly an expansion valve capable of properly controlling the refrigerant flow rate even when there are changes of pressure in the refrigerant circuit.

To this end, according to the invention, a thermostatic expansion valve is provided having a refrigerant inlet passage, a refrigerant outlet passage, a valve chest to which both the passages open, a diaphragm chamber communicating with a heat-sensitive bulb through a tube of small diameter, and a valve body actuated in response to the operation of a diaphragm. The valve body is disposed facing a valve seat in the valve chest to regulate a passage defined between the valve seat and the valve body to thereby control the flow rate of a refrigerant. The expansion valve is further provided with an axially movable valve seat disposed on the inner wall of the valve chest, with the valve seat being adapted to be axially moved in accordance with a change of pressure in a refrigerant circuit by allowing a high-pressure fluid and a low-pressure fluid in the refrigerant circuit to act on both sides of the valve seat, to thereby to add the movement of the valve seat corresponding to a change of pressure in the refrigerant circuit to the movement of the valve body corresponding to the refrigerant temperature detected through the heat-sensitive bulb. By virtue of the features of the present invention, the refrigerant flow rate is controlled in accordance with a change of the refrigerant temperature and a change of pressure in the refrigerant circuit through the movements of both the valve body and the valve seat, thereby making it possible to control the refrigerant flow rate so as to be a proper value corresponding to operating conditions changing over a wide range.

Above and other objects, features and advantages of the invention will become apparent from the following description taken in connection with the accompanying drawings.

DESCRIPTION OF THE PREFERRED EMBODIMENTS

Figure 1:
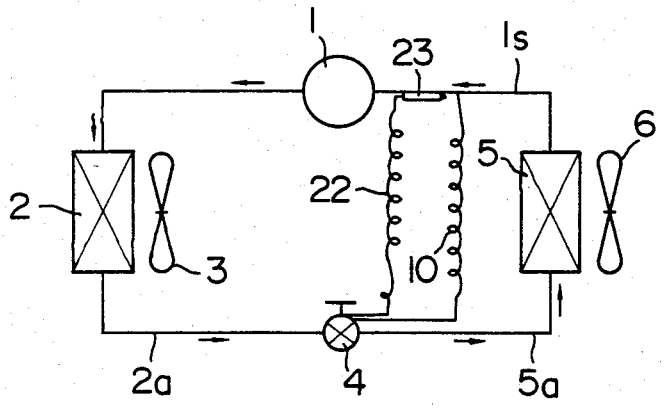
FIG. 1 is a diagram showing a refrigerant circuit in which an expansion valve in accordance with the invention is employed.

Referring first to FIG. 1, a refrigerant circuit of a refrigerating apparatus, air conditioner or the like, includes a gaseous refrigerant compressed by a compressor 1, with the refrigerant exchanging, in a condenser 2, heat with the air sent by a blower 3 to condense refrigerant, with the liquid refrigerant being introduced into an expansion valve 4. The expansion valve 4 senses the temperature of the refrigerant sucked into the compressor 1 by means of a heat-sensitive bulb 23, which is communicated with the expansion valve 4 through a tube 22 of small diameter. The opening of the expansion valve 4 varies with the sensed temperature to control the flow rate of the circulating refrigerant so that the refrigerant having a reduced pressure is introduced into an evaporator 5 at a proper flow rate. In the evaporator 5, the refrigerant exchanges heat with the room air sent by a blower 6, absorbing heat from the room air to evaporate, and is then sucked into the compressor 1. The room air is cooled through the heat exchange and is made to serve for refrigeration or air cooling. The above-mentioned operation is continuously carried out; hence, refrigeration or air cooling is effected continuously. A pressure equalizing tube 10 provides communication between a suction piping ls of the compressor 1 and the expansion valve 4. Arrows indicate the circulating direction of the refrigerant.

Figure 2:
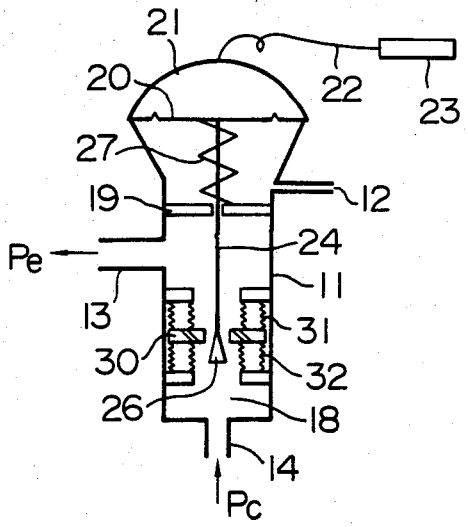
FIG. 2 schematically shows the construction of an embodiment of the expansion valve in accordance with the invention.
Figure 3:
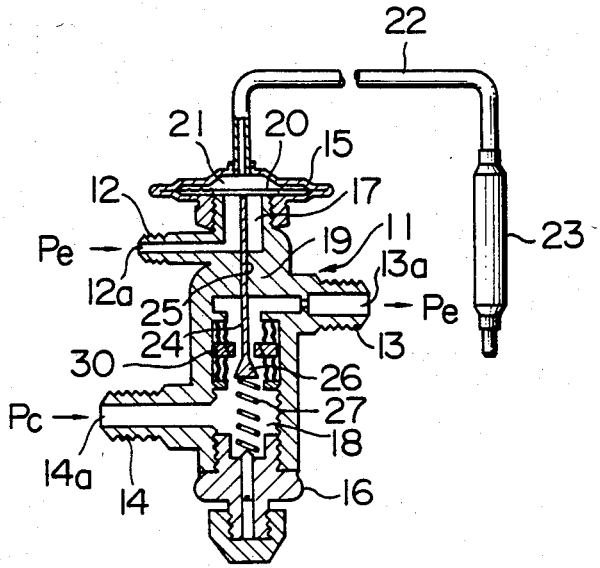
FIG. 3 is a sectional view of the expansion valve shown in FIG. 2, illustrating a practical construction thereof.
Figure 4:
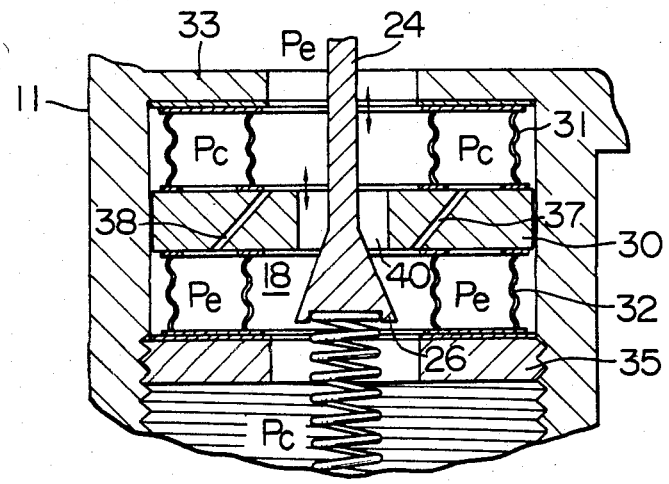
FIG. 4 is an enlarged detail view of a movable valve seat portion of the expansion valve shown in FIG. 3.

As shown in FIGS. 2, 3 and 4, the expansion valve 4 includes a main body 11 having a pressure equalizing tube connecting tubular portion 12, a low-pressure side connecting tubular portion 13 and a high-pressure side connecting tubular portion 14 which are respectively projected from the upper part, intermediate part and lower part thereof. In addition, the body 11 has a diaphragm cap 15 and a plug 16 respectively screwed to the upper and lower part thereof.

The body 11 has in its upper center a pressure chamber 17, to which a pressure equalizing tube connecting passage 12*a* is connected and opened. The body 11 is opened at its lower part and has a valve chest 18 formed next to the opening. The valve chest 18 has a high-pressure side connecting passage 14*a* connected to and opened into the lower part thereof as well as a low-pressure side connecting passage 13*a* connected to and opened into the upper part thereof. The pressure chamber 17 and the valve chest 18 are isolated from each other by means of a partition wall 19. A diaphragm 20 is attached to the upper end of the body 11 through the diaphragm cap 15. The tube 22 is connected to and opened into a diaphragm chamber 21 defined between the diaphragm cap 15 and the upper side of the diaphragm 20 and has the heat-sensitive bulb 23 attached to the other end thereof. The heat-sensitive bulb 23, the tube 22 and the diaphragm chamber 21 are charged with a gas or liquid whose pressure varies with temperature, e.g., a refrigerant, the pressure of which acts on the diaphragm 20. The upper end of a valve stem 24 is fixed to the lower surface of the diaphragm 20. The valve stem 24 penetrates through the pressure chamber 17 and a stem bore 25 formed in the partition wall 19 to extend into the valve chest 18 and has a conical valve body 26 provided on its lower end. A spring 27 urges the valve body 26 upwardly, with the movement of the valve stem 24 being controlled through the balance between the pressure in the diaphragm chamber 21 and the force of the spring 27. A movable valve seat 30 is slidably disposed in the valve chest 18 and has annular bellows 31, 32 disposed on both sides thereof. The upper end of the bellows 31 is fixed to an annular fixing seat 33 projected from the inner wall of the valve chest 18, while the lower end of the bellows 32 is fixed to an annular fixing seat 35 screwed to the inner wall of the valve chest 18. The valve body 26 is disposed below the valve seat 30, facing the same. The valve seat 30 has a high-pressure inlet bore 37 and a low-pressure inlet bore 38 formed therethrough. The high-pressure inlet bore 37 provides communication between the lower surface of the valve seat 30 and the inside of the hermetically sealed upper bellows 31, while the low-pressure inlet bore 38 provides communication between the upper surface of the valve seat 30 and the inside of the hermetically sealed lower bellows 32. Accordingly, the inside of the upper bellows 31 is subjected to the high-side pressure Pc in the lower part of the valve chest 18 divided by the valve seat 30, while the inside of the lower bellows 32 is subjected to the low-side pressure Pe in the upper part of the valve chest 18 divided by the valve seat 30.

In the expansion valve having the above construction, as described hereinbefore, the heat-sensitive bulb 23 is connected to the suction piping ls in the refrigerant circuit; the high-pressure side connecting passage 14*a* is connected to an outlet-side conduit 2*a* of the condenser 2; the low-pressure side connecting passage 13*a* is connected to an inlet-side conduit 5*a* of the evaporator 5; and the connecting passage 12*a* is connected to the pressure equalizing tube 10.

The expansion valve having the above construction operates as follows. Namely, the temperature (degree of superheat) of a refrigerant sucked and flowing in through the suction piping ls of the compressor 1 in the refrigerant circuit is detected by the heat-sensitive bulb 23, and a pressure corresponding to the detected temperature is transmitted to the diaphragm chamber 21 through the tube 22. The diaphragm 20 is transformed in accordance with this pressure. In response to this transformation, the valve stem 24 is actuated to regulate the opening of a valve passage 40 defined by the gap between the valve body 26 and the valve seat 30, so that the flow rate of the refrigerant flowing from the high-pressure side connecting passage 14*a* to the low-pressure side connecting passage 13*a* is controlled in accordance with the opening of the valve passage 40.

Thus, the high-side pressure Pc of the refrigerant condensed in the condenser (not shown) in a refrigerating cycle is applied to the lower side of the valve body 26 from the connecting passage 14*a* in the expansion valve body, and at the same time, the pressure Pc is introduced into the bellows 31 through the high-pressure introducing bore 37 to act on the upper surface of the movable valve seat 30. On the other hand, the low-side pressure Pe is introduced into the bellows 32 from the low-pressure introducing bore 38 formed in the movable valve seat 30 through the connecting passage 13*a* connected to the evaporator side, to act on the lower surface of the valve seat 30. Accordingly, the flow rate of the refrigerant is determined by the displacement of the valve stem 24 controlled through the balance between the diaphragm 20 and the spring 27 and the displacement of the valve seat 30 moving in accordance with the difference between the high-side pressure Pc and the low-side pressure Pe. When the difference between the high- and low-side pressures, i.e., Pc−Pe is large, the pressure in the bellows 31 acting on the upper surface of the valve seat 30 is large so that the valve seat 30 moves downwardly to narrow the valve passage 40 defined between the valve body 26 and the valve seat 30, thereby controlling a decrease in the flow rate to of the refrigerant. When the pressure difference becomes small, the valve seat 30 moves upwardly, to the contrary, so as to return to its initial position while enlarging the valve passage 40 between the valve body 26 and the valve seat 30, thereby increasing the flow rate of the refrigerant.

As described above, the expansion valve in accordance with the invention controls the flow rate of the refrigerant through the movement of the valve body (valve stem) while moving the valve seat 30 according to the difference between the high- and low-side pressures in the refrigerant circuit. The relationship between the pressure difference (Pc−Pe) and the refrigerant flow rate will be described hereinunder in detail with reference to FIG. 5.

Figure 5:
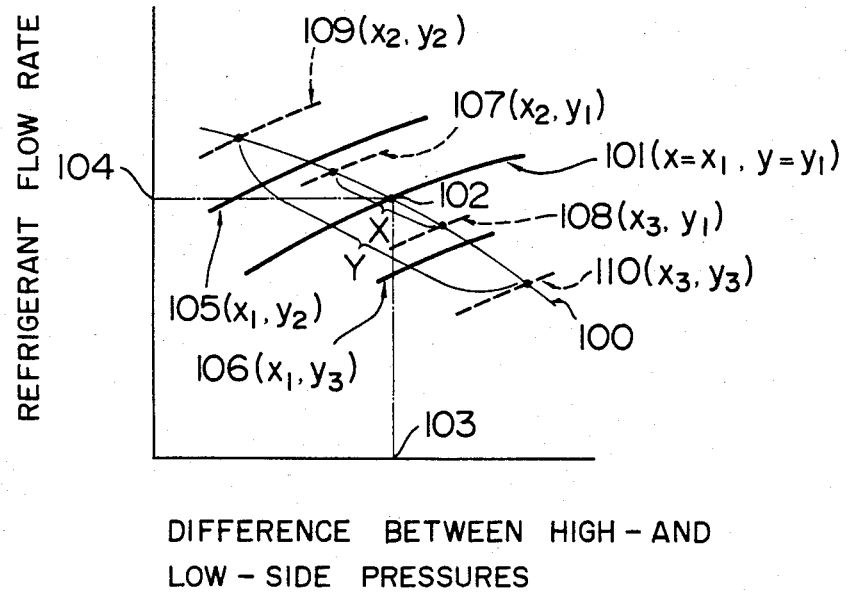
FIG. 5 is a graph showing refrigerant flow rate characteristic curves.

As shown in FIG. 5, a compressor characteristic curve 100, representing the relationship between the high- and low-side pressure difference and the refrigerant flow rate, is a curve declining as it goes rightward as viewed in the FIG. 5, since the larger the pressure difference (Pc−Pe), the smaller the flow rate. On the other hand, the control characteristic curve of the expansion valve is a curve declining as its goes leftward as viewed in FIG. 5, since the larger the pressure difference, the larger the refrigerant flow rate. If it is assumed that the displacement of the valve stem 24 is represented by x, while the displacement of the valve seat 30 is represented by y, and the characteristic curve of the expansion valve obtained when $x=x_1$ and $y=y_1$ is represented by a curve 101, then, the intersection 102 between the compressor characteristic curve 100 and the expansion valve characteristic curve 101 is the operation working point of the refrigerant circuit at a pressure difference (Pe−Pc) 103, and a refrigerant flow rate 104 is obtained. Moreover, the expansion valve characteristic curve is represented by a curve 105 when the displacement x of the valve stem 24 is unchanged, i.e., $x_1$ but the displacement y of the valve seat 30 is changed to $y_2$. Further, the expansion valve characteristic curve is represented by a curve 106 when x is kept constant, i.e., $x_1$ but y is changed to $y_3$. On the other hand, when the valve seat displacement y is kept constant, i.e., $y_1$ but the valve stem displacement x is changed to $x_2$, the expansion valve characteristic curve is represented by a curve 107, and when y is unchanged, i.e., $y_1$ but x is changed to $x_3$, a characteristic curve 108 is obtained. Furthermore, when x is changed to $x_2$ and y is changed to $y_2$, the expansion valve characteristic curve is represented by a curve 109, and when x is changed to $x_3$ and y is changed to $y_3$, a characteristic curve 110 is obtained.

It will be understood from the above that if the displacement of the valve seat 30 is maintained constant at $y_1$ but the displacement of the valve stem 24 is changed from $x_2$ to $x_3$, the flow rate regulating operation of the expansion valve is effective at intersections between the compressor characteristic curve 100 and the expansion valve characteristic curves within a range shown by x so that the refrigerant flow rate can be properly regulated in accordance with the pressure difference. However, if also the displacement of the valve seat 30 is changed from $y_2$ to $y_3$ in addition to the change of the displacement of the valve stem 24 from $x_2$ to $x_3$, then, the properly regulatable range can be enlarged to a range shown by y. As described above, if the displacement of the valve seat 30 is added to the displacement of the valve stem 24, then, it is possible to effect a wider range of flow rate regulation in accordance with a wider range of operating conditions, from a small pressure difference (Pc−Pe) due to a large reduction in delivery pressure to a large pressure difference (Pc−Pe) due to a rise in delivery pressure, than that in the case where only the valve stem 24 is displaced, thereby making it possible to properly control the refrigerant flow rate.

It is to be noted that the expansion valve in accordance with the above-described embodiment is of outer-equalizing type. In case of an inner-equalizing type expansion valve, however, the pressure equalizing tube connecting tubular portion 12, the pressure equalizing tube connecting passage **12*a* and the pressure equalizing tube 10 are unnecessary but instead a small bore (not shown) is formed in the partition wall 19 to provide communication between the pressure chamber 17 and the low-pressure side connecting passage 13*a***.

As will be understood from the above description, the expansion valve in accordance with the invention is adapted to effect a refrigerant flow rate control that the valve stem is moved through the action of the diaphragm in accordance with the degree of superheat (temperature) of the refrigerant sucked into the compressor and moreover a refrigerant flow rate control that the valve seat is moved in accordance with the difference between the pressures on the high- and low-pressure sides in the refrigerant circuit. Accordingly, the expansion valve can control the refrigerant flow rate over a wider range. Particularly, the expansion valve can set a proper refrigerant flow rate in accordance with any changes of the high- and low-side pressures in the refrigerant circuit.

Figure 6:
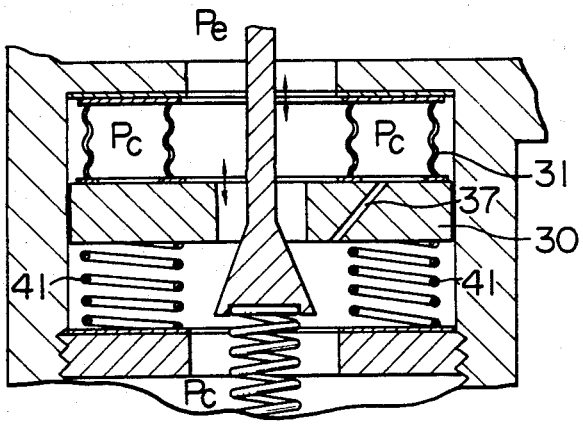
FIG. 6 is a sectional view of a part of another embodiment of the expansion valve in accordance with the invention, particularly showing a movable valve seat portion thereof.

The embodiment of FIG. 6 differs from the first-described embodiment in that springs 41 are disposed on the lower side of the valve seat 30.

More specifically, the bellows 31 similar to that in the first-described embodiment is provided on the upper side of the valve seat 30, and the inside of the bellows 31 is maintained at the high-side pressure Pc in the refrigerant circuit through the high-pressure introducing bore 37. The springs 41 are provided on the lower side of the valve seat 30. The other members and portions are the same as those in the first-described embodiment; hence, the illustration and description thereof are omitted.

The embodiment shown in FIG. 6 is effective in a refrigerant circuit in which the low-side pressure Pe varies within a narrow range and the high-side pressure Pc varies over a wide range. In addition, since this embodiment has only one bellows, the production cost is advantageously lower than that of the first-described embodiment. The valve seat 30 moves in accordance with the difference between the high-side pressure Pc and the pressing forces of the springs 41, i.e., in accordance with the change in the high-side pressure Pc. The operations of the other members and portions are the same as those in the first-described embodiment.

Figure 7:
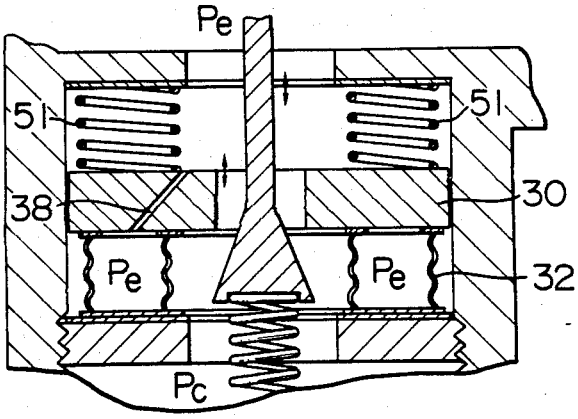
FIG. 7 is a sectional view of a part of still another embodiment of the expansion valve in accordance with the invention, particularly showing a movable valve seat portion thereof.

The embodiment of FIG. 7 is effective in a refrigerant circuit in which the high-side pressure Pc hardly varies but the low-side pressure Pe largely varies, contrary to the embodiment shown in FIG. 6.

More specifically, a plurality of springs 51 are disposed on the upper side of the valve seat 30, and the bellows 32, similar to that in the embodiment shown in FIG. 4, is disposed on the lower side of the valve seat 30. The inside of the bellows 32 is maintained at the low-side pressure Pe in the refrigerant circuit through the low-pressure introducing bore 38. The valve seat 30 moves in accordance with the difference between the low-side pressure Pe and the pressing forces of the springs 51, i.e., in accordance with the change in the low-side pressure Pe. Since the constructions and operations of the other members and portions are the same as those in the embodiment shown in FIG. 4, the description thereof is omitted. Also this embodiment has only one bellows; hence, the production cost is advantageously lower than that of the embodiment shown in FIG. 4.

Although the invention has been described through specific terms, it is to be noted here that the described embodiments are not exclusive and various changes and modifications may be imparted thereto without departing from the scope of the invention which is limited solely by the appended claims.

What is claimed is:

1. An expansion valve having a refrigerant inlet passage, a refrigerant outlet passage, a valve chest to which both the inlet and outlet passages open, a diaphragm chamber communicating with a heat-sensitive bulb through a small diameter tube, and a valve body actuated in response to an operation of a diaphragm, said valve body being disposed facing a valve seat in said valve chest to regulate a passage defined between said valve seat and said valve body to thereby control the flow rate of a refrigerant, said valve seat is adapted to be axially movable along an inner wall of said valve chest, and means for moving said valve seat in accordance with a change in pressure in a refrigerant circuit including annular bellows attached to both sides of said valve seat, annular fixing seats for respectively fixing the other ends of said bellows, a first passage means for introducing a high pressure fluid into one of said bellows, a second passage means for introducing a low-pressure fluid into the other of the bellows to thereby move said valve seat in accordance with a change in difference between high- and low-pressure side pressures in the refrigerant circuit.

2. An expansion valve according to claim 1, wherein said valve body is formed at an end of a valve stem into a conical shape diverging toward its end and disposed closer to said bellows into which a low-pressure fluid is introduced, so that a valve passage is defined by a conical surface of said valve body and the edge of an opening formed in said valve seat.

3. An expansion valve according to claim 1, wherein said first and second passage means for respectively introducing the high-pressure fluid and the low-pressure fluid into the bellows are formed in said valve seat.

4. An expansion valve according to claim 1, wherein said annular fixing seats for respectively fixing said bellows are integrally projected from the inner wall of said valve chest.

5. An expansion valve according to claim 1, wherein said annular fixing seats for respectively fixing said bellows are threadably secured to the inner wall of said valve chest.

* * * * *